US005752720A

United States Patent [19]

Pynenburg

[11] Patent Number: 5,752,720

[45] Date of Patent: May 19, 1998

[54] TAPE BINDING SYSTEM

[75] Inventor: Adrian W. Pynenburg, Brantford, Canada

[73] Assignee: Storeimage Programs Inc., Brantford, Canada

[21] Appl. No.: 691,504

[22] Filed: Aug. 2, 1996

[51] Int. Cl.[6] ..... B42D 1/00

[52] U.S. Cl. ..... 281/2; 281/5; 281/38; 283/61

[58] Field of Search ..... 281/2, 5, 3.1, 9, 281/12, 14, 38, 40, 41, 44; 283/61, 62, 44; 428/42.2, 42.3

[56] References Cited

U.S. PATENT DOCUMENTS

| | | | |
|---|---|---|---|
| 4,768,810 | 9/1988 | Mertens | 281/5 X |
| 5,018,764 | 5/1991 | Beardell | 283/61 X |
| 5,641,550 | 6/1997 | Berman et al. | 281/2 X |

*Primary Examiner*—Wilmon Fridie, Jr.
*Attorney, Agent, or Firm*—Howard J. Greenwald

[57] ABSTRACT

A pad comprised of three leaves, each of which preferably has a numerical indicia displayed on each side of it. Each leaf is joined to two other leaves by means of a first segment of adhesive tape and a second segment of adhesive tape. The end portions of each of such tape segments are contiguous with one of said leaves, but the middle portions of the tape segments are not contiguous with such leaves.

20 Claims, 6 Drawing Sheets

TAPE BINDING SYSTEM

FIELD OF THE INVENTION

A pad suitable for displaying numbers in a retail sign display.

BACKGROUND OF THE INVENTION

Price indicating devices for use in retail stores are well known to those skilled in the art.

Thus, for example, in U.S. Pat. No. 1,472,928 of MacKenzie, there is disclosed a device containing a price ticket with a lower price-indicating portion and an upper blank portion, a description ticket superimposed on the blank portion of the price indicating ticket, and means for suspending these tickets from a supporting structure.

Thus, U.S. Pat. No. 1,857,580 of Arnold discloses a price marking device comprising a mounting member having an opening in the front thereof, a plurality of strips attached at one end to the mounting member and having transverse folds at regularly spaced points to form a plurality of panels having price marking characters thereon, and means to engage the ends of the folded panels to retain the same within the opening.

Thus, U.S. Pat. No. 2,202,268 of Rohlfes discloses a price-marking device comprising a flexible card having flaps on the top and bottom edges and folding over the upper and lower margins of the card to detachably hold and expose the price-indicating elements.

Thus, U.S. Pat. No. 2,334,083 of Greenwald et al. discloses an interchangeable sign having a container formed with a top window opening and an opening in a side wall thereof and enclosing a sign unit, the sign unit comprising a pair of adjacent U-shaped portions.

Thus, U.S. Pat. No. 2,626,472 of Stingl discloses a price tag comprising spaced separate individual side members, each of which comprises a strip of sheet metal including an intermediate portion with the edge portions on opposite sides of the intermediate portion folded upon themselves.

These United States patents are merely illustrative of the many price indicating devices which have been developed. Unfortunately, none of these prior price indicating devices is totally satisfactory.

It is an object of this invention to provide a pad which is relatively inexpensive, which is durable, which is lightweight, and which can readily be used even by unskilled laborers.

SUMMARY OF THE INVENTION

In accordance with this invention, there is provided a pad comprised of three leaves, each of which preferably has a numerical indicia displayed on each side of it. Each leaf is joined to two other leaves by means of a first segment of adhesive tape and a second segment of adhesive tape. The end portions of each of such tape segments are contiguous with one of said leaves, but the middle portions of the tape segments are not contiguous with such leaves.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

In one embodiment of this invention, the pad is a price pad whose leaves contain numerical indicia. In another embodiment, not shown, these indicia do not appear on the leaves.

The pad of this invention preferably contains at either three leaves, four leaves, or five more leaves.

Figure 1:
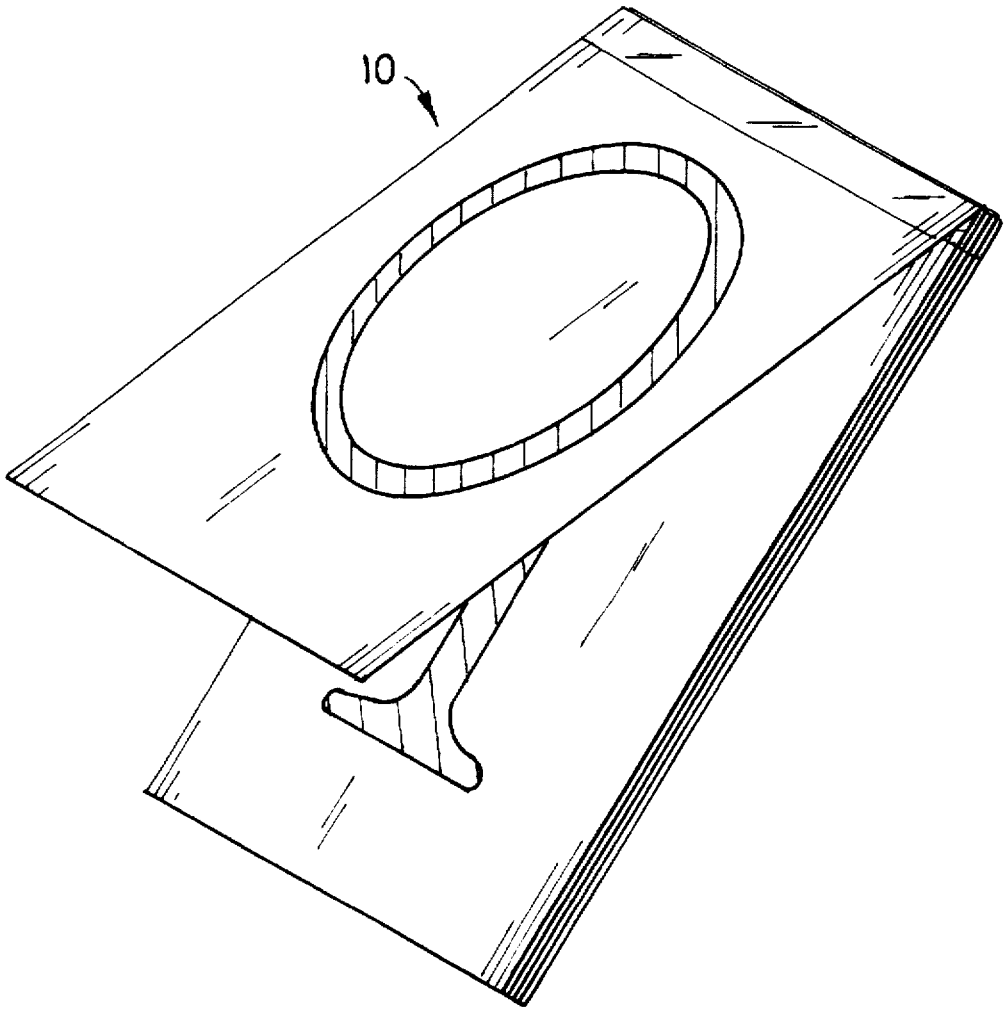
FIG. 1 is a top view of one preferred price pad of the invention in it open position.

FIG. 1 is a top view of a price pad 10 which, in the preferred embodiment illustrated, has six leaves 12, 14, 16, 18, 20, and 22 joined to each other by six strips of adhesive tape 24, 26, 28, 30, 32, and 34.

Referring to FIG. 1, and in the embodiment depicted therein, the price pad 10 is comprised of at least 5 leaves 12, 14, etc., and it preferably is comprised of from about 5 to about 8 such leaves. In one preferred embodiment, illustrated in FIG. 1, price pad 10 contains from 6 to 7 such leaves.

Referring again to FIG. 1, and in the preferred embodiment depicted therein, it will be seen that leaves 12, 14, 16, 18, 20, and 22 each have a thickness 36 of from about 0.005 to about 0.03 inches; the thickness of each of leaves 12, 14, 16, 18, 20, and 22 may be same (and preferably they are), or they may differ. In one embodiment, thickness 36 is preferably from about 0.008 to about 0.02 inches. In another embodiment, thickness 36 is from about 0.009 to about 0.015 inches.

Figure 4:
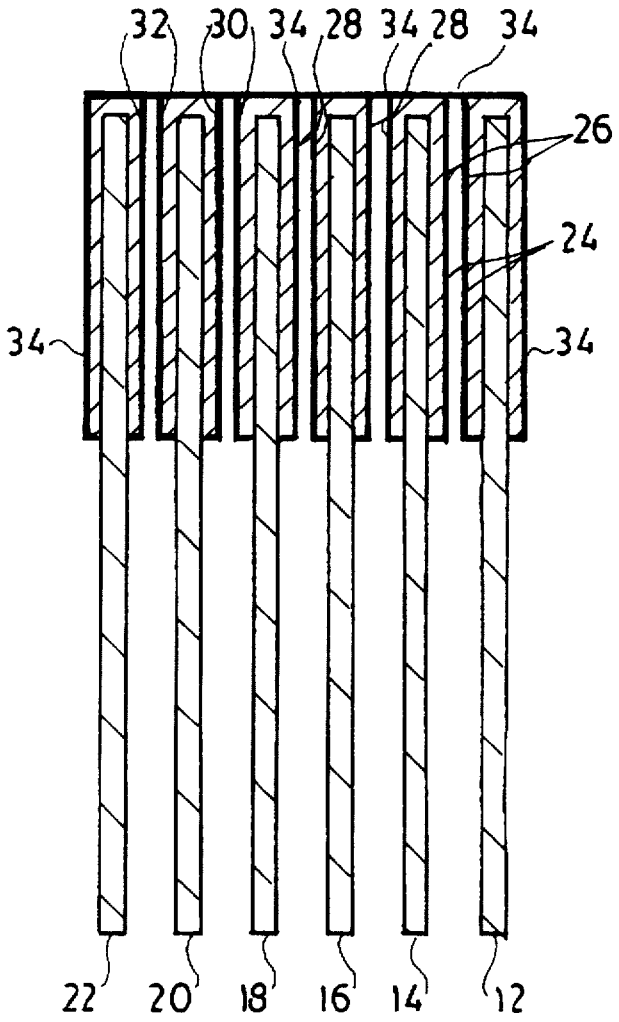
FIG. 4 is an expanded view of a portion of the price pad depicted in FIG. 3.

FIG. 4 illustrates the thickness of leaf 12 at a point 38 in such leaf 12 where it is not enclosed by tape 24, and also at a point 40 in such leaf, where it is enclosed by tape 24. Referring to FIG. 4, it will be seen that the thickness 42 of leaf 12 at a point where both sides of it are enclosed by tape 24 is form about 0.008 to about 0.25 inches; the thickness 42 of each of leaves 12, 14, 16, 18, 20, and 22 may be same (and preferably they are), or they may differ. In one embodiment, thickness 42 is preferably from about 0.01 to about 0.02 inches.

In general, tape 24, 26, 28, 30, 32, and/or 34 has a thickness (as measured by A.S.T.M. Standard Test D-3652-83, "Test Method for Thickness of Pressure Sensitive Tape . . . ") of from about 0.001 to about 0.002 inches. In one preferred embodiment, each of tapes 24, 26, 28, 30, 32, and 34 has a thickness of from about 1.3 to about 1.7 mils.

Referring again to FIG. 1, it will be seen that, at point 44, each of tapes 24, 26, 28, 30, 32, and 34 is adhesively connected to at least two adjacent tapes. Thus, e.g., tape 24 is adhesively connected to tapes 34 and 26 at about point 44. Tape 26 is adhesively connected to tapes 24 and 28 at about point 44. Tape 28 is adhesively connected to tapes 26 and 30 at about point 44. Tape 30 is adhesively connected to tapes 28 and 32 at about point 44. Tape 32 is adhesively connected to tapes 30 and 34 about point 44. Tape 34 is adhesively connected to tape 32 and tape 24 at about point 44.

Figure 2:
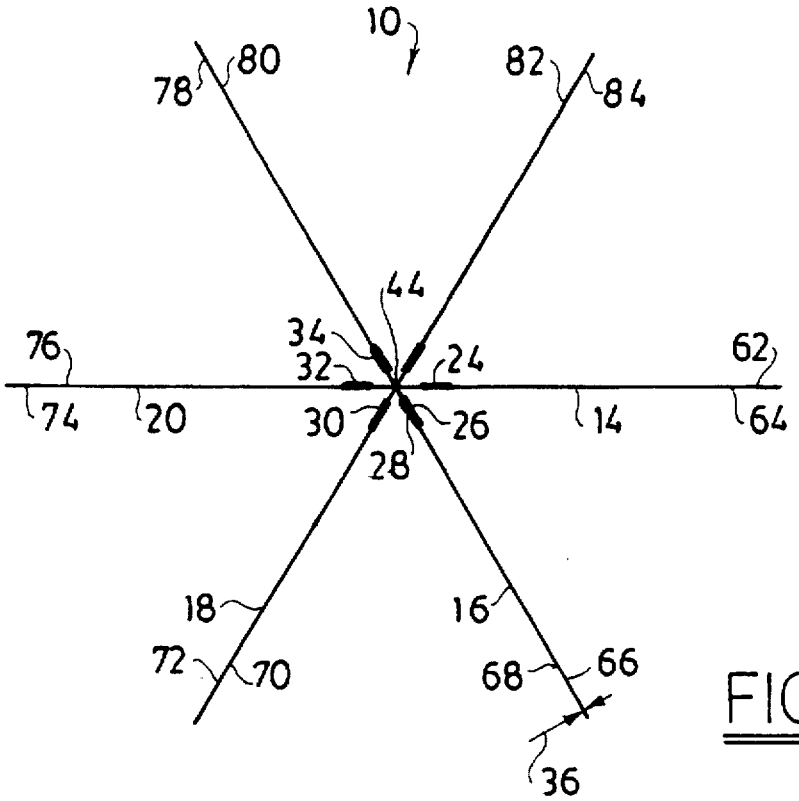
FIG. 2 is a top view of the preferred price pad of FIG. 1 prior to the time its leaves are joined by adhesive tape.

FIG. 2 is a top view of the price pad 10 of FIG. 1 prior to the time leaves 12, 14, 16, 18, 20, and 22 are joined by adhesive tape.

Referring to FIG. 2, it will be seen that leaf 14 has a length 46 from about 1 inch to about 24 inches. It is preferred that length 46 be from about 3 inches to about 16 inches. It is also preferred that the length 46 of leaf 14 be substantially identical to the lengths (not shown) of each of leaves 16, 18, 20, 22, and 12 so that, when such leaves are compressed, they form a substantially compact structure, such as that depicted in FIG. 3.

Referring again to FIG. 2, and in the preferred embodiment depicted therein, it will be seen that each of leaves 12, 14, 16, 18, 20, and 22 are preferably disposed equidistantly around an imaginary circle so that, after adhesive tape is affixed to these leaves, it can be formed into a substantially symmetrical structure, such as that depicted in FIG. 1.

Figure 3:
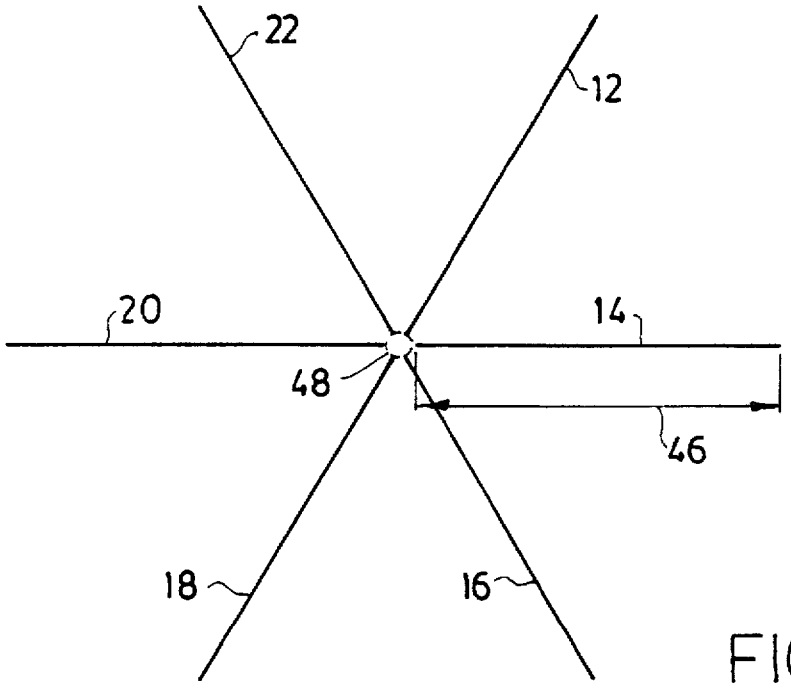
FIG. 3 is a top view of the price pad of FIG. 1 in its closed position.

FIG. 3 is a top view of price pad 10, illustrating how it appears when it is closed. It will be seen that, because each of the leaves 12, 14, 16, 18, 20, and 22 has substantially the same length, they all terminate at substantially the same plane 50.

FIG. 4 is an expanded view of a portion of the price pad 10 depicted in FIG. 3.

Figure 5:
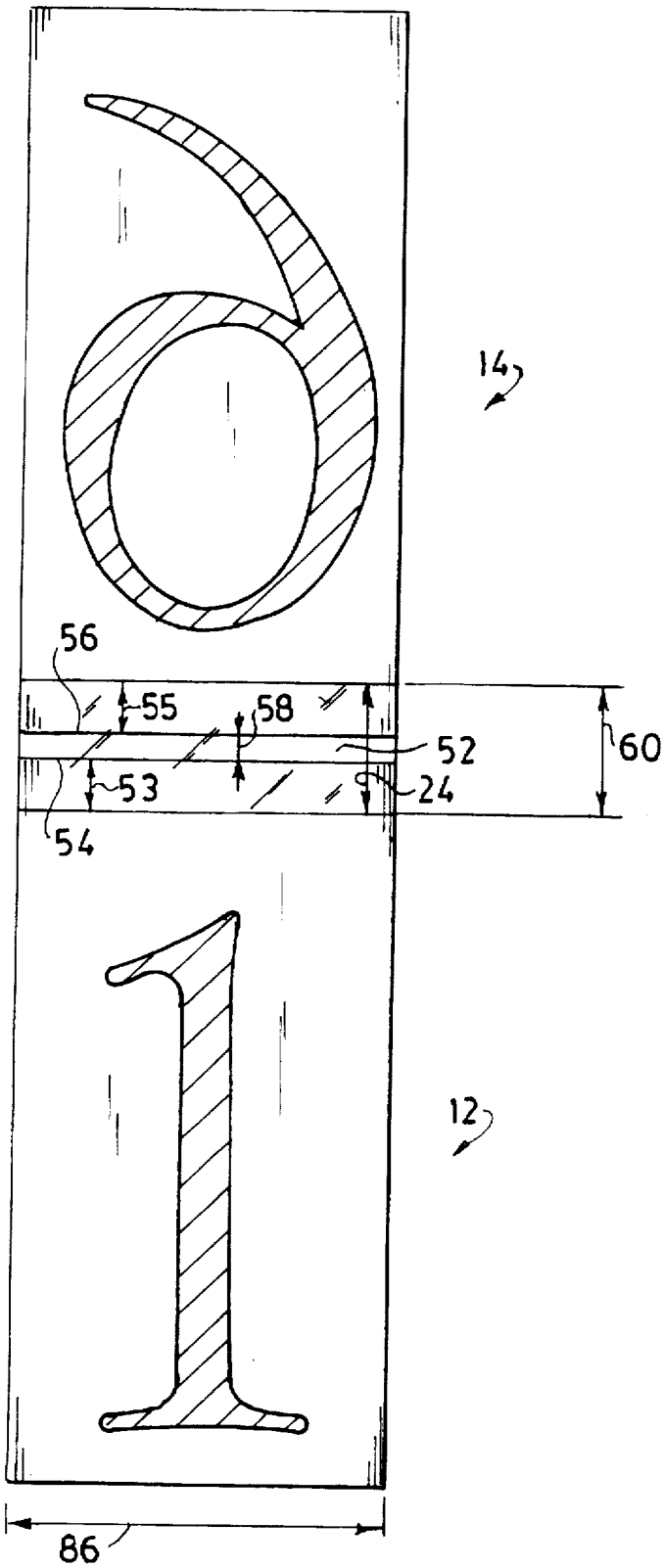
FIG. 5 is a top view of a portion of the price pad of FIG. 1.
Figure 6:
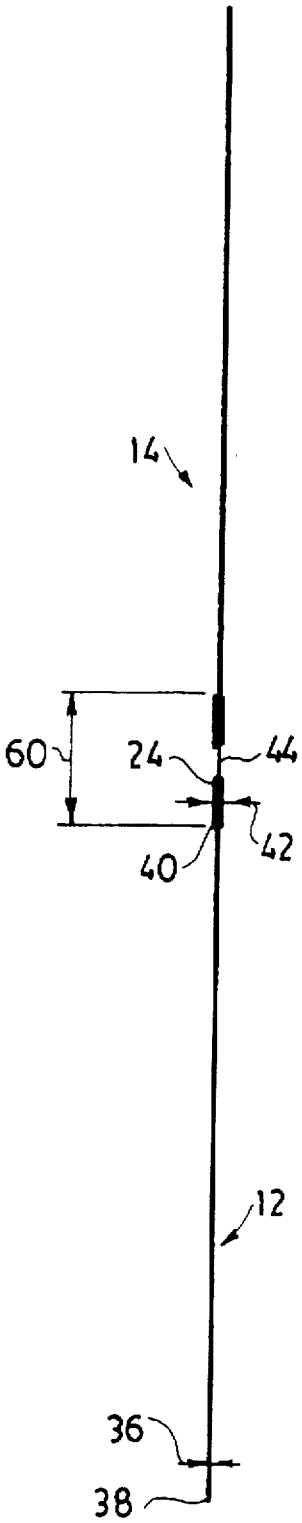
FIG. 6 is a side view of the portion of the price pad of FIG. 3.

FIG. 5 is a top view of a portion of the price pad of FIG. 3, showing how leaves 12 and 14 are joined to each other.

Referring to FIG. 5, it will be seen that adhesive joins leaves 12 and 14 so that there is a gap 52 between the top surface 54 of leaf 12 and the top surface 56 of leaf 14.

It will be seen that gap 52 preferably has a width 58 of from about 0.1 to about 0.25 inches. In one embodiment, gap 52 has a width 58 of 0.11 to about 0.15 inches.

Referring again to FIG. 5, it will be seen that leaf 12 and leaf 14 are adhesively joined by tape 24. As will be apparent from FIG. 1, it will also be seen that leaf 12 and leaf 14 are adhesively joined by tapes 34 and 26, respectively.

Referring again to FIG. 5, and in the preferred embodiment depicted therein, it will be seen that tape 24 (and the comparable tapes 34 and 26) have a width 60 of at least about 0.6 inches. Although the tape 24 can have a maximum width substantially equal to the length of the leaves, it is preferred that the maximum width 60 be about 1.2 inches.

The tape 24 is contiguous with ends 54 and 56 of leaves 12 and 14 and overlap said ends 54 and 56 by at least a specified amount. Referring to FIG. 5, it will be seen that the tape 24 overlaps leaf 12 by a distance 53 of at least about 0.17 inches and, preferably, at least about 0.25. Similarly, tape 24 overlaps leaf 14 by a similar distance 55 of at least about 0.17 inches.

Referring again to FIG. 5, it will be seen that each of leaves 12 and 14 has a numerical indicia (such as the numeral 1 or 9) printed on it. As will be apparent to those skilled in the art, the opposite sides of leaves 12 and 14 also have numerical indicia printed on them.

Referring again to FIG. 1, and in the embodiment depicted therein, side 62 of leaf 14 may have the numeral 1, side 64 of leaf 14 may have the numeral 2, side 66 of leaf 16 may the numeral 3, side 68 of leaf 16 may have the numeral 4, side 70 of leaf 18 may have the numeral 5, side 72 of leaf 18 may have the numeral 6, side 74 of leaf 20 may have the numeral 7, side 76 of leaf 20 may have the numeral 8, side 78 of leaf 22 may have the numeral 9, side 80 of leaf 22 may be 0, and sides 82 and 84 of leaf 24 may be blank. Other suitable arrangements will be readily apparent to those skilled in the art.

Referring again to FIG. 5, and in the preferred embodiment depicted therein, it will be seen that leaf 12 (and also preferably leaves 14, 16, 18, 20, and 22) preferably has a width 86 of from about 0.7 to about 24 inches. In one preferred embodiment, width 86 is from about 2 to about 6 inches.

Figure 7:
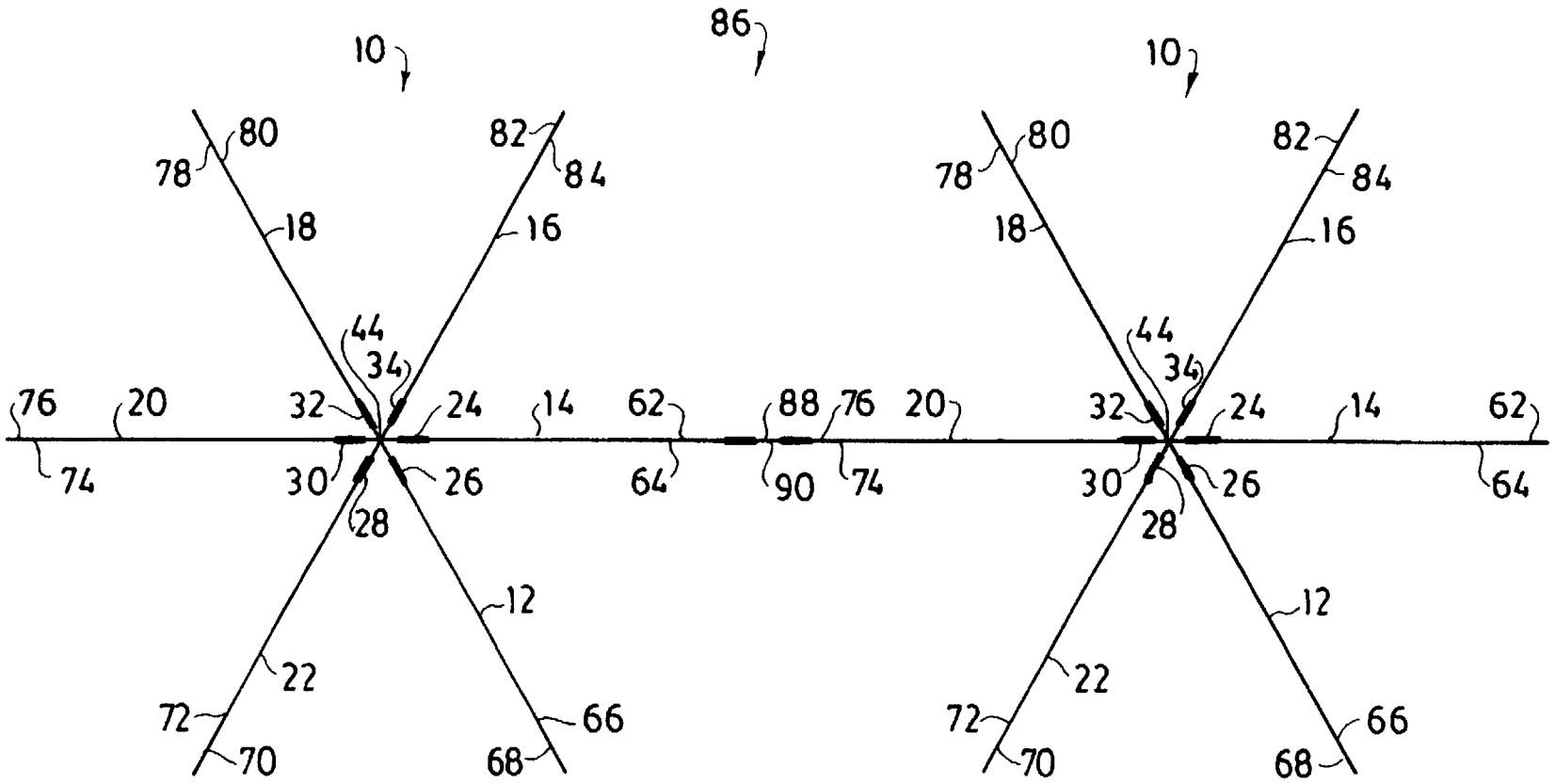
FIG. 7 is a top view of a preferred triple spined brochure of this invention.

FIG. 7 is a top view of a preferred composite binding 86 which is comprised of two bound structures 10 joined together by means of tapes 88 and 90. In the embodiment depicted in FIG. 7, each of the bound structures 10 contains six leaves. However, in such composite structures, the bound structures 10 may contain as few as two leaves and as many as eight leaves. Other suitable composite structures also are possible. Thus, e.g., a third bound structure 10 may be added along the linear chain.

In one preferred embodiment, the tapes 24, 26, 28, 30, 32, and 34 are preferably pressure sensitive tapes. As is known to those skilled in the art, these types of tape can be applied with hand pressure in the absence of solvents or heat and it sticks aggressively to most common surfaces. See, e.g., U.S. Pat. Nos. 2,328,066, 2,340,298, 2,647,843, 2,532,011, 2,607,711, 2,876,895, 2,913,355, 2,985,545, 3,061,567, 2,799,596, 2,725,981, 2,848,355, 2,848,105, 3,068,121, 2,444,830, 2,750,314, 2,615,059, 2,697,084, 2,999,769, 3,239,478, reissue Pat. No. 24,906, 3,558,574, 3,535,293, 3,299,010, and the like. The disclosure of each of these patents is hereby incorporated by reference into this specification.

The backings for the pressure sensitive tapes used in this invention can be cloth, paper, films, foils, strand reinforced backings, and laminated backings. In one preferred embodiment, a film backing selected from the group consisting of cellophane film, polyvinyl chloride film, polyester film, polypropylene film, and cellulose acetate film is used.

It us preferred that the tape used in the price pad of this invention have an adhesion to steel, as measured by A.S.T.M. Standard Test D-3330-87 ("Test Method for Peel Adhesion of Pressure Sensitive Tape . . . "), of at least about 25 ounces per inch of width. In one embodiment, the adhesion is from about 25 to about 35 ounces per inch of width.

It is preferred that the tape used in the price pad of this invention have a tensile strength at break, as measured by A.S.T.M. Standard Test D-3759-83 ("Test Method for Tensile Strength and Elongation of Pressure Sensitive Tape") of at least about 20 pounds per inch of width and, more preferably, at least about 26 pounds per inch of width.

It is preferred that the tape used in the price pad of this invention have an Elongation at break, as measured by A.S.T.M. Standard Test D-3759-83, of from about 100 to about 130 percent.

It is preferred that the tape used in the price pad of this invention have a backing thickness, as measured by A.S.T.M. Standard Test D-3652-83 ("Test Method for Thickness of Pressure Sensitive Tape . . . ") of from about 0.7 mils to about 1.3 mils and, more preferably, from about 0.9 mils to about 1.1 mils.

Figure 8:
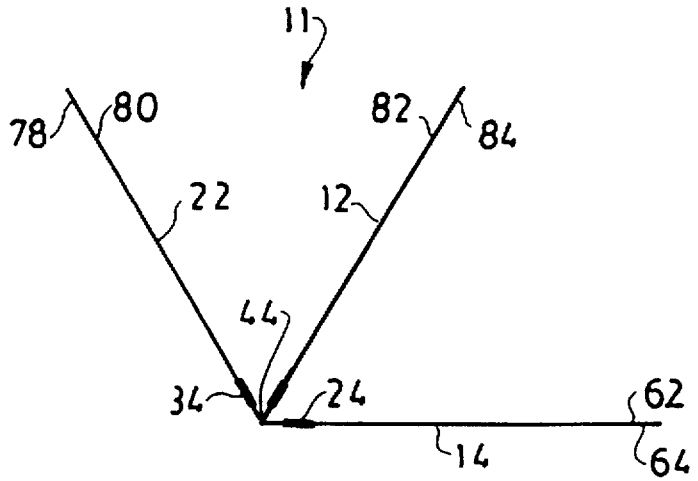
FIG. 8 is a top view of another preferred pad of this invention.

FIG. 8 is a top view of a pad 11, which is preferably a price pad, comprised of indicia (not shown), which contains three leaves.

Figure 9:
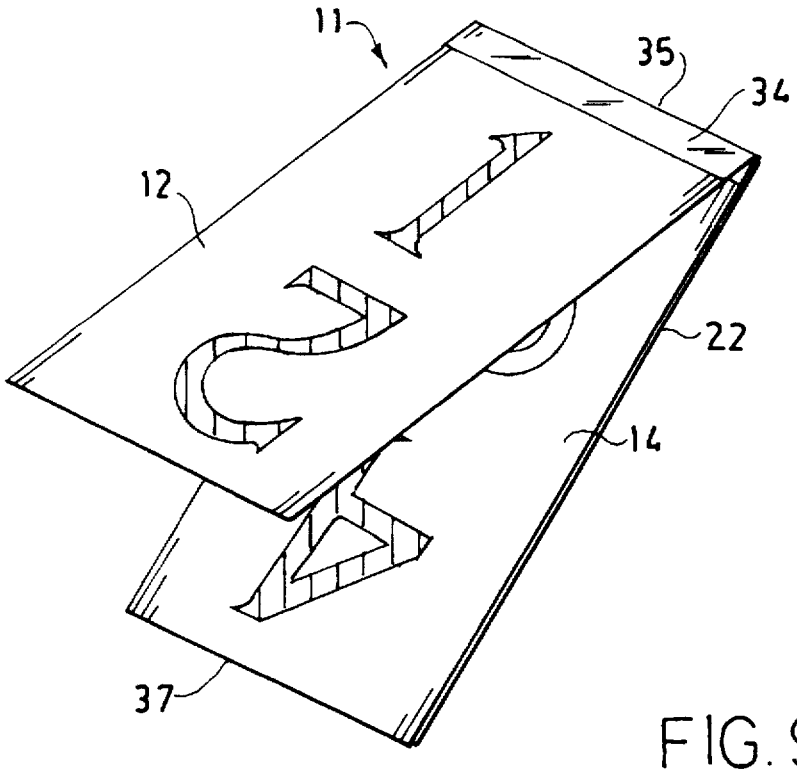
FIG. 9 is a perspective view of the pad of FIG. 8.

FIG. 9 is a perspective view of pad 11. It will be noted that, one at least one side of each of leaves 12, 14, and 22

(and, preferably, on both sides of said leaves), there are two numerical indicia so disposed with regard to each other that, when the top 35 of assembly 11 is pointed upwards, one number is properly displayed, and when the bottom 37 of assembly 11 is pointed upwards, then the other number is properly displayed. As will be obvious to those skilled in the art, when the other side of leaves 12 and/or 14 and/or 22 is displayed, similarly disposed numerical indicia also can appear.

In one embodiment, not shown, price pad 11 is utilized with a display device adapted to mask the numerical indicia which is not facing upwardly.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A pad comprised of a first leaf, a second leaf, and a third leaf, wherein:

(a) said first leaf is comprised of a first side and a second side, (b) said second leaf is comprised of a third side and a fourth side, (c) said third leaf is comprised of a fifth side and a sixth side, (d) said first leaf is adhesively joined to said second leaf by a first adhesive tape contiguous with said second side and said third side, said second leaf is adhesively joined to said third leaf by a second adhesive tape contiguous with said fourth side and said fifth side, said third leaf is adhesively joined to said first leaf by a third adhesive tape contiguous with said sixth side and said first side, (e) a first end of said first leaf is enclosed by adhesive tape, a second end of second leaf is enclosed by adhesive tape, and a third end of said third leaf is enclosed by adhesive tape, (f) said first end of said first leaf is not contiguous with said second end of said second leaf, or said third end of said third leaf, (g) said second end of said second leaf is not contiguous with said first end of said first leaf, or said third end of said third leaf, and (h) said third end of said third leaf is not contiguous with said first end of said first leaf, or said second end of said second leaf.

2. A pad comprised of a first leaf, a second leaf, a third leaf, a fourth leaf, and a fifth leaf, wherein:

(a) said first leaf is comprised of a first side and a second side, (b) said second leaf is comprised of a third side and a fourth side, (c) said third leaf is comprised of a fifth side and a sixth side, (d) said fourth leaf is comprised of a seventh side and a eighth side, (e) said fifth leaf is comprised of a ninth side and a tenth side, (f) said first leaf is adhesively joined to said second leaf by a first adhesive tape contiguous with said second side and said third side, said second leaf is adhesively joined to said third leaf by a second adhesive tape contiguous with said fourth side and said fifth side, said third leaf is adhesively joined to said fourth leaf by a third adhesive tape contiguous with said sixth side and said seventh side, said fourth leaf is adhesively joined to said fifth leaf by a fourth adhesive tape contiguous with said eighth side and said ninth side, and said fifth leaf is adhesively joined to said first leaf by a fifth adhesive tape contiguous with said tenth side and said first side, wherein a first end of said first leaf is enclosed by adhesive tape, a second end of second leaf is enclosed by adhesive tape, a third end of said third leaf is enclosed by adhesive tape, a fourth end of said fourth leaf is enclosed by adhesive tape, and a fifth end of said fifth leaf is enclosed by adhesive tape, (g) said first end of said first leaf is not contiguous with said second end of said second leaf, said third end of said third leaf, said fourth end of said fourth leaf, and said fifth end of said fifth leaf, (h) said second end of said second leaf is not contiguous with said first end of said first leaf, said third end of said third leaf, said fourth end of said fourth leaf, and said fifth end of said fifth leaf, (i) said third end of said third leaf is not contiguous with said first end of said first leaf, said second end of said second leaf, said fourth end of said fourth leaf, and said fifth end of said fifth leaf, (j) said fourth end of said fourth leaf is not contiguous with said first end of said first leaf, said second end of said second leaf, said third end of said third leaf, and said fifth end of said fifth leaf; and (k) said fifth end of said fifth leaf is not contiguous with said first end of said first leaf, said second end of said second leaf, said third end of said third leaf, and said fourth end of said fourth leaf.

3. The pas as recited in claim 2, wherein said pad is a price pad, and wherein a first numerical indicia is displayed on said first side, a second numerical indicia is displayed on said second side, a third numerical indicia is displayed on said third side, a fourth numerical indicia is displayed on said fourth side, a fifth numerical indicia is displayed on said fifth side, a sixth numerical indicia is displayed on said sixth side, a seventh numerical indicia is displayed on said seventh side, and an eighth numerical indicia is displayed on said eighth side.

4. The price pad as recited in claim 3, wherein each of said first leaf, said second leaf, said third leaf, said fourth leaf, and said fifth leaf has a thickness of from about 0.005 to about 0.03 inches.

5. The price pad as recited in claim 3, wherein each of said first leaf, said second leaf, said third leaf, said fourth leaf, and said fifth leaf has a length of from about 3 to about 16 inches.

6. The price pad as recited in claim 3, wherein each of said first leaf, said second leaf, said third leaf, said fourth leaf, and said fifth leaf has substantially the same dimensions.

7. The price pad as recited in claim 3, wherein each of said first tape, said second tape, said third tape, said fourth tape, and said fifth tape has a width of at least about 0.6 inches.

8. The price pad as recited in claim 3, wherein each of said first leaf, said second leaf, said third leaf, said fourth leaf, and said fifth leaf has a width of from about 0.7 to about 6.0 inches.

9. The price pad as recited in claim 3, wherein each of said first adhesive tape, said second adhesive tape, said third adhesive tape, said fourth adhesive tape, and said fifth adhesive tape is a pressure sensitive tape.

10. The price pad as recited in claim 3, wherein each of said first adhesive tape, said second adhesive tape, said third adhesive tape, said fourth adhesive tape, and said fifth adhesive tape has a backing consisting essentially of polyester film.

11. The price pad as recited in claim 3, wherein each of said first adhesive tape, said second adhesive tape, said third adhesive tape, said fourth adhesive tape, and said fifth adhesive tape has an adhesion to steel of at least about 25 ounces per inch of width.

12. The price pad as recited in claim 3, wherein each of said first adhesive tape, said second adhesive tape, said third adhesive tape, said fourth adhesive tape, and said fifth adhesive tape has tensile strength at break of at least about 20 pounds per inch of width.

13. The price pad as recited in claim 3, wherein each of said first adhesive tape, said second adhesive tape, said third adhesive tape, said fourth adhesive tape, and said fifth adhesive tape has an elongation at break of from about 100 to about 130 percent.

14. The price pad as recited in claim 3, wherein each of said first adhesive tape, said second adhesive tape, said third adhesive tape, said fourth adhesive tape, and said fifth adhesive tape has a backing thickness of from about 0.7 mils to about 1.3 mils.

15. The price pad as recited in claim 4, wherein each of said first leaf, said second leaf, said third leaf, said fourth leaf, and said fifth leaf has a length of from about 3 to about 16 inches.

16. The price pad as recited in claim 15, wherein each of said first leaf, said second leaf, said third leaf, said fourth leaf, and said fifth leaf has substantially the same dimensions.

17. The price pad as recited in claim 16, wherein each of said first tape, said second tape, said third tape, said fourth tape, and said fifth tape has a width of at least about 0.6 inches.

18. The price pad as recited in claim 17, wherein each of said first leaf, said second leaf, said third leaf, said fourth leaf, and said fifth leaf has a width of from about 0.7 to about 6.0 inches.

19. The price pad as recited in claim 18, wherein each of said first adhesive tape, said second adhesive tape, said third adhesive tape, said fourth adhesive tape, and said fifth adhesive tape is a pressure sensitive tape.

20. The price pas as recited in claim 19, wherein each of said first adhesive tape, said second adhesive tape, said third adhesive tape, said fourth adhesive tape, and said fifth adhesive tape has a backing consisting essentially of polyester film.

* * * * *